US005566482A

United States Patent [19]

Smith

[11] Patent Number: 5,566,482

[45] Date of Patent: Oct. 22, 1996

[54] CHANGEABLE IMAGE DISPLAY DEVICE

[75] Inventor: Michael J. Smith, Orangeburg, N.Y.

[73] Assignee: Arrow Art Finishers, Inc., Bronx, N.Y.

[21] Appl. No.: 380,597

[22] Filed: Jan. 30, 1995

[51] Int. Cl.[6] ..... G09F 3/04

[52] U.S. Cl. ..... 40/450; 40/492

[58] Field of Search ..... 40/450, 451, 492, 40/503, 506, 606; 116/306

[56] References Cited

U.S. PATENT DOCUMENTS

| | | | |
|---|---|---|---|
| 3,789,525 | 2/1974 | Bugg . | |
| 4,024,532 | 5/1977 | Sherwin . | |
| 4,223,464 | 9/1980 | Winrow . | |
| 4,509,279 | 4/1985 | Greenberger | 40/492 X |
| 4,658,527 | 4/1987 | Pingel | 40/606 |
| 4,860,471 | 8/1989 | Bonanomi . | |
| 4,977,697 | 12/1990 | Genick | 40/606 |
| 5,315,775 | 5/1994 | Parker et al. | 40/450 |
| 5,388,356 | 2/1995 | Kalivas | 40/450 |

FOREIGN PATENT DOCUMENTS

| | | | |
|---|---|---|---|
| 2605435 | 4/1988 | France . | |
| 9417510 | 8/1994 | WIPO | 40/450 |

*Primary Examiner*—Brian K. Green
*Attorney, Agent, or Firm*—Kirschstein, et al.

[57] ABSTRACT

A changeable image display sign includes a carrier panel of corrugated board material that includes a plurality of openings each corresponding to a different segment of the changeable image. The sign further includes a plurality of image-forming elements of the corrugated board material, each having oppositely facing first and second major surfaces visually conforming to and differing from at least one of the exposed major surfaces, respectively. A multitude of shafts each passing through respective interstices of the corrugated board material of the carrier panel and of at least an associated one of the image-forming elements is used for mounting the image-forming elements in the openings.

15 Claims, 3 Drawing Sheets

FIG. 1
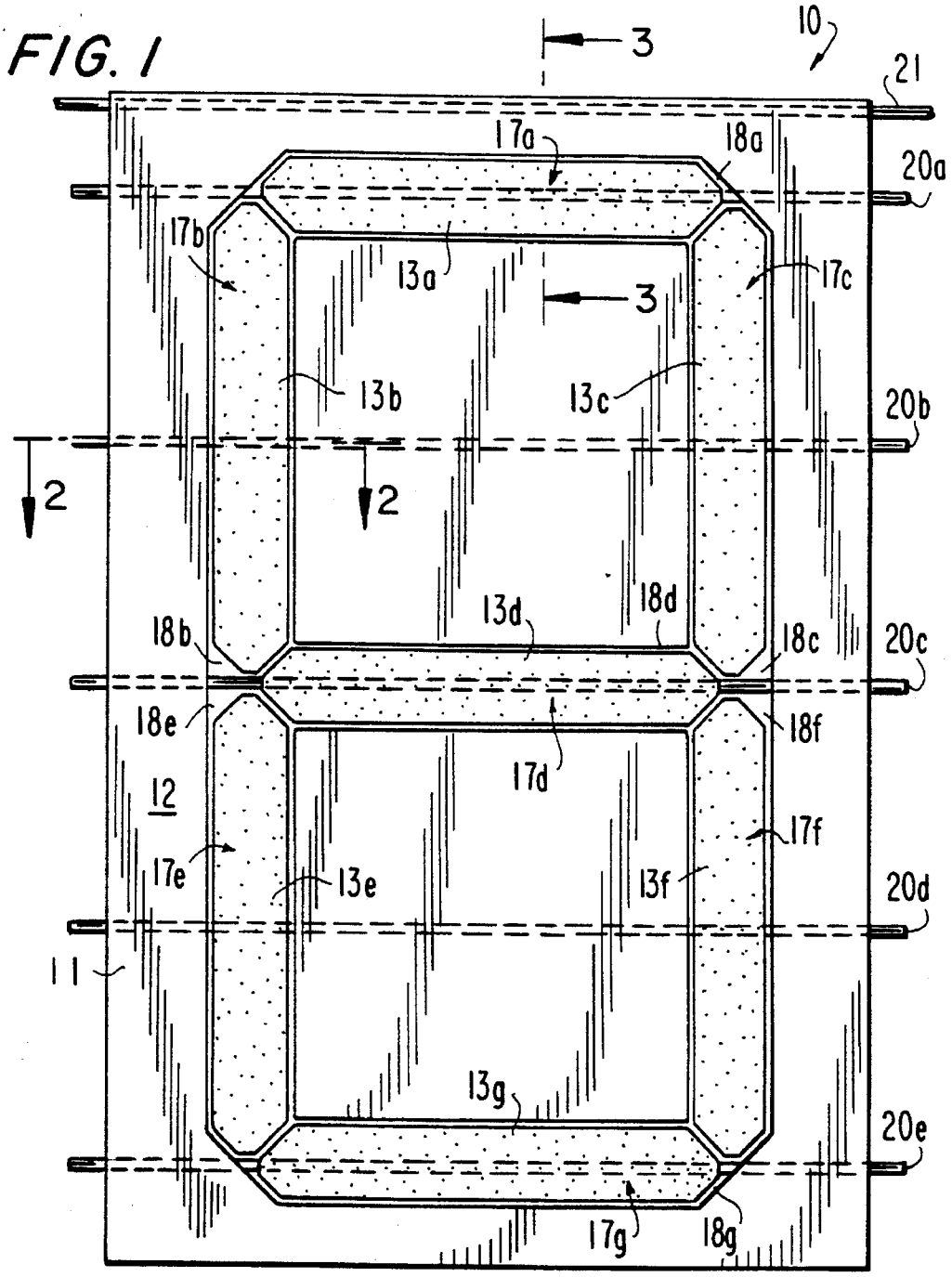
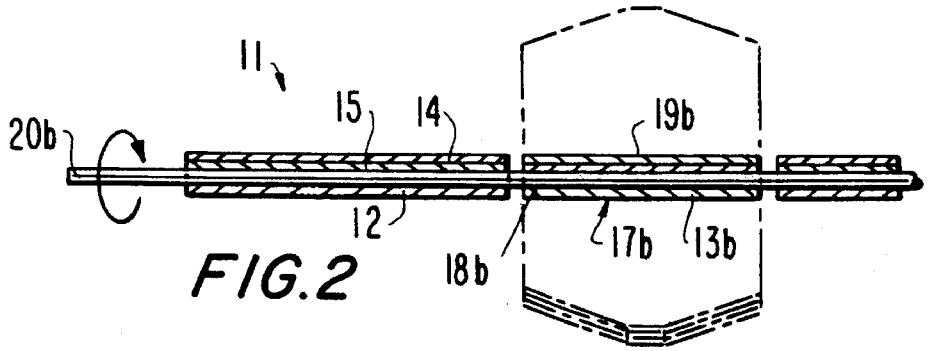
FIG. 2

CHANGEABLE IMAGE DISPLAY DEVICE

BACKGROUND OF THE INVENTION

1. Field of the Invention

The present invention relates generally to displaying images, and more particularly to image displaying devices capable of exhibiting changeable indicia.

2. Description of the Related Art

There are already known various constructions of image displaying devices or signs, among them such capable of displaying indicia that are changeable at will. In one type of such devices, of which examples can be found, for instance, in U.S. Pat. Nos. 4,223,464 to Winrow; 4,860,471 to Bonanomi; 3,789,525 to Bugg; 4,024,532 to Sherwin; and 5,315,775 to Parker et al., the displayed image is formed collectively by a plurality of segments each constituted by a separate element that is movable between its active and inactive positions in which it is visually distinguishable from, and blends with, its surroundings, respectively.

Devices of the kind disclosed in the first four of the patents listed above are frequently employed at airports, bus or train terminals or stations, or at other transportation centers or hubs for displaying, for instance, the departure and/or arrival times and destinations or points of origin of various flights, buses, trains or the like. Another frequent use for such devices is along or above streets, highways or similar traffic arteries to provide travelers either with advisory or warning information from proper authorities about road conditions or the like, or with advertising information relating, for instance, to nearby or upcoming business establishments such as those offering food, lodging or gas.

In these and similar applications, the remote addressability of the various elements that collectively constitute the changeable image being displayed necessitates the provision of respective drives for selectively moving such elements between their active and inactive positions, and of a control device that operates the drives in the desired manner as the image is being changed. This, of course, makes each such device quite complex and, consequently, expensive. Moreover, relatively highly skilled personnel is needed to operate the control device in the desired manner to produce the required image on the display device.

In view of these characteristics, display devices of this kind have not found their way into retail stores, even though there is a pronounced need for them to inform prospective customers of buying opportunities. While this degree of complexity is not present in the fifth of the aforementioned patents because that device is constructed for manual displacement of the elements between their active and inactive positions, that device is still quite complex and, hence, expensive because the mounting panel and the elements are not only made of a synthetic plastic material which is quite an expensive proposition, but also provided with separate shaft and bearing components for each of the elements, complicating their manufacture and particularly their assembly. Thus, even devices of this type are not alluring enough to cause them to be used in retail establishments.

OBJECTS OF THE INVENTION

Accordingly, it is a general object of the present invention to avoid the disadvantages of the prior art.

More particularly, it is an object of the present invention to provide a changeable display sign that does not possess the drawbacks of the known signs of this type.

Still another object of the present invention is to devise a changeable display sign of the type here under consideration which can be made from a commonly available corrugated board material.

It is yet another object of the present invention to design the above sign in such a manner as to simplify its assembly and use to the greatest possible extent.

A concomitant object of the present invention is so to construct the changeable display sign of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a changeable image display device that includes, as one of its main components, a carrier panel of corrugated board material that includes a pair of substantially planar outer walls each having an exposed major surface, and an intermediate wall interposed between the outer walls, extending along an undulating course repeatedly from one of the outer walls to the other and back, and connected to the outer walls at regions of closest approach thereto to define respective flutes or closed interstices of a predetermined cross-sectional area therewith.

The carrier panel is provided with a plurality of openings each corresponding to a different segment of the changeable image. There is further provided a plurality of image-forming elements of the corrugated board material, each of such elements being adapted to be substantially conformingly received in one of the openings of the carrier panel and having oppositely facing first and second major surfaces visually conforming to and differing from at least one of the exposed major surfaces, respectively. There is further provided means for mounting the image-forming elements in the openings each for turning about an axis between its active and inactive positions in which the first and the second major surface thereof is substantially flush with the one major surface of the carrier panel, respectively. In accordance with the invention, the mounting means includes a multitude of elongated shafts each passing through respective associated ones of the interstices of the corrugated board material of the carrier member and of at least an associated one of the image-forming elements.

According to an advantageous aspect of the present invention, each of the shafts has a cross-sectional area less than the predetermined cross-sectional area of the interstices. Alternatively, the cross-sectional area of each of the shafts can be such as to obtain a frictional fit in the respective one of the interstices.

The changeable image display device may further advantageously include a backing panel hingedly connected to the carrier panel at an upper region thereof and configured substantially conformingly to the carrier panel. The carrier and backing panels form a notch at the upper region thereof. This notch may be used in accordance with the invention for receiving an elongated support member to suspend the display device in a straddling position therefrom. Especially in this context, it is particularly advantageous when there is further provided connecting means, such as an adhesive tape or at least one pair of Velcro™ fasteners for connecting the carrier and backing panels to one another at a lower region thereof.

According to another advantageous facet of the present invention, the changeable display device further includes, in addition to the carrier and backing panels, a bottom wall that is operative for supporting the display device on a horizontal support surface. The bottom wall is hingedly connected to a lower region of the carrier panel and has an upstanding abutment portion remote from the carrier panel and serving as an abutment for a lower region of the backing panel to prevent excessive spreading thereof apart from the carrier panel.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a front elevational view of a display sign embodying the present invention;

FIG. 2 is a cross-sectional view of a portion of the display stand, taken on line 2—2 of FIG. 1;

DETAILED DESCRIPTION OF THE PREFERRED EMBODIMENT

Figure 3:
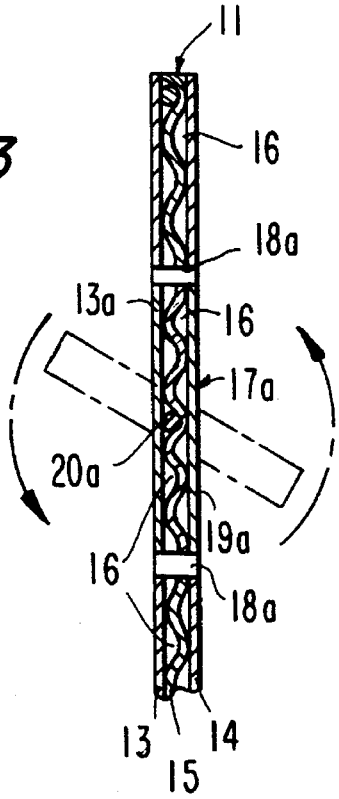
FIG. 3 is a sectional view of another portion of the display stand, taken on line 3—3 of FIG. 1.

Referring now to the drawing in detail, and first to FIG. 1 thereof, it may be seen that the reference numeral 10 has been used therein to identify a changeable display sign of the present invention in its entirety. The display sign 10 includes, as one of its basic components, a carrier member 11 that has a front major surface 12 constituting a background or ambient surface of the sign 10. The carrier member 11 carries a plurality of segments 13*a* to 13*n*, wherein n represents any positive integral number.

In the implementation illustrated in FIG. 1 of the drawing, n amounts to seven, meaning that there are seven of such segments denoted as 13*a* to 13*g*. These segments 13*a* to 13*g* are distributed on the carrier member 11 in a manner that is well known, for instance from digital watch design, to collectively form a stylized numeral "8" when all of them are activated (i.e., given appearances different from the ambient surface 12).

Yet, as is also well known, if any one or any combination of the segments 13*a* to 13*g* is selectively inactivated, the remainder of the segments 13*a* to 13*g*, if any, still forms an image or indicium that can be easily visually distinguished from the ambient surface 12, with that image being different in each instance. This seven-segment arrangement renders it possible to construct all single-digit numbers from "0" to "9", as well as a few capital letters such as "E", "L" and "U", but not the entire alphabet.

To be able to provide a complete complement of alphanumeric characters that would additionally include at least those capital letters that are impossible to construct using the seven-segment arrangement, the number of the segments 13*a* to 13*n* would have to be increased, and their distribution would have to be chosen appropriately in accordance with well known principles. Generally speaking, it is contemplated to utilize the present invention with any number of the segments 13*a* to 13*n* that may be needed to form, in various combinations or permutations of the activated ones of the segments 13*a* to 13*n*, possibly even in a mosaic-like fashion, a multitude of different (not necessarily alphanumeric) images, for example, puzzles, visually discernible against the backdrop of the ambient surface 12.

As a consideration of FIGS. 1 to 3 in conjunction with one another will reveal, the carrier member 11 is sheet-shaped and, in a currently preferred embodiment of the present invention, made of corrugated board either of paper or synthetic plastic material. This means that the carrier member 11 includes two substantially flat outer walls or skins 13 and 14—of which the wall 13 has the ambient major surface 12—and an intermediate wall 15 interposed between the outer walls 13 and 14. The intermediate wall 15 is corrugated, that is, it extends along an undulating course repeatedly back and forth between the outer walls 13 and 14, and is either connected, typically glued, to, or is integral with, the outer walls 13 and 14 at the regions of its closest approach thereto. As can best be seen in FIG. 3 of the drawing, the individual undulations of the intermediate wall 15 delimit respective interstices or flutes 16 between themselves and the respective regions of the outer walls 13 and 14 that span the valleys of such undulations.

Of course, the general construction of corrugated board is well known and would not have to be discussed here at all were it not for the fact that, as will be discussed in some detail later, it is utilized in an advantageous manner in accordance with the present invention to provide a simple and inexpensive construction of the changeable sign 10. The aforementioned visually distinguishable segments 13*a* to 13*g* are provided on respective discrete image-forming elements 17*a* to 17*g*. Only the elements 17*b* and 17*a* are identified and shown in detail in FIGS. 2 and 3, respectively, in order not to unduly encumber the drawing. However, it is to be understood that the following description of construction and operation is equally applicable to all of the elements 17*a* to 17*g* even if specific description is provided with respect to only one of them.

As may be observed especially in FIG. 3 of the drawing, the element 17*a*, like the carrier member 11, is of sheet material, preferably corrugated board material, and is received in a compatibly configured opening 18*a* of the carrier member 11 so as to be substantially coplanar with the carrier member 11 in its active position in which the segment 17*a* is substantially flush with the ambient surface 12 of the carrier member 11, as well as in its inactive position in which it is an oppositely facing major surface 19*a* of the element 17*a* that is substantially flush with the ambient surface 12. In this inactive position, the element 17*a* is virtually visually indistinguishable from the ambient surface 12 of the carrier member 11, particularly from the distance from which the sign 10 is intended to be viewed, not only because the gap between the edge region of the carrier member 11 that bounds the opening 18*a* and the corresponding edge region of the element 17*a* is chosen to be so small as to almost disappear from view or leave just a faint contour of the element 17*a* when the latter is in its inactive position, but also, and more importantly, because the surface 19*a* of the element 17*a* is not provided with any distinguishing mark akin to the segment 13*a* and, as a matter of fact, is substantially of the same color, texture and general appearance as the ambient or background surface 12 of the carrier member 11.

For a variety of reasons that will be discussed below, it is advantageous and contemplated by the present invention to make the carrier member 11 and the elements 13*a* to 13*g* of the same corrugated board stock, and more particularly, from the same corrugated board sheet by die-cutting or stamping the elements 13*a* to 13*g* out of the carrier member 11, leaving the openings 18*a* to 18*g* behind. For one, the choice of the same stock or of the very same sheet eliminates the possibility of encountering variations in coloring, texture, thickness etc. that would make the elements 17*a* to 17*g* more prominent in their inactive positions than desired. Furthermore, the cutting of the elements 17*a* to 17*g* from regions located within the boundaries of the mounting member 11 not only improves the utilization of the corrugated board material and minimizes the number of cuts, but also, and more importantly, assures that the elements 17*a* to 17*g* are complementary to the associated openings 18*a* to 18*g*, with only the desired amount of leeway given by the width of the cut, and with no overlap. Last but not least, the cutting of the elements 17*a* to 17*g* out of the appropriate regions of the carrier member 11 results in a situation in which the flutes 16 of the elements 13*a* to 13*g* and those of the carrier member are aligned with each other and form continuations of one another.

This latter feature is an important, if not critical, consideration in the context of the present invention, particularly since the respective flutes 16 are being used in accordance with the present invention to accommodate respective supporting shafts 20*a* to 20*e*, as may be most clearly perceived from a comparison of FIGS. 1 and 2. The support shafts 20*a*, 20*b*, 20*c*, 20*d* and 20*e* support the elements 17*a*, 17*b* and 17*c*, 17*d*, 17*e* and 17*f*, and 17*g*, respectively, on the carrier member 11 for turning about the respective longitudinal axes of the support shafts 20*a* to 20*e* between their aforementioned active and inactive positions, as indicated by respective arcuate arrows in FIGS, 2 and 3 of the drawing.

The support shafts may be made of a rigid material, such as metal rods, or of a resilient material, such as a taut elastomeric element. When rigid rods are used, the rods are preferably dimensioned to be received in the respective flutes 16 in a substantially fitting manner, that is, with at most only a minimum amount of leeway but preferably in frictional engagement with the surfaces bounding the flutes 16. The fitting accommodation of the rods 20*a* to 20*e* in the flutes 16, coupled with the aligned relationships of the flutes 16 of the elements 17*a* to 17e with the corresponding flutes 16 of the carrier member 11, assure that the respective elements 17*a* to 17*g* are fully received in the associated openings 18*a* to 18*g* both in their active and their inactive positions.

This, of course, presupposes that the elements 17*a* to 17*g* and the associated openings 18*a* to 18*g* are symmetrical about respective axes that coincide with the longitudinal axes of the rods 20*a* to 20*e* in the assembled condition of the sign 10, since otherwise the respective elements 17*a* to 17*g* would be fully received in the associated openings 18*a* to 18*g* in one but not the other of their active and inactive positions. Yet, within this limitation, the elements 17*a* to 17*g* and their associated openings 18*a* to 18*g* could have any desired compatible or complementary outlines, each possibly but not necessarily being also symmetrical about an axis normal to the respective longitudinal axis. As shown especially in FIG. 1 of the drawing, the elements 17*a* to 17*g* are indeed symmetrical in this manner as well and have generally rectangular configurations but with triangularly or trapezoidally tapering ends. This not only provides an impression of continuity of the indicium or image when the sign 10 is observed from the intended distance, but also that of certain degree of roundness that would not be present if the elements 17*a* to 17*g* were purely rectangular.

As shown in FIG. 1 of the drawing, and as mentioned before, the elements 17*a* to 17*g* are typically received in their associated openings 18*a* to 18*g* with a certain degree of leeway that accounts for the widths of the cuts and/or manufacturing and alignment tolerances. This means that the outer edge surfaces of the elements 17*a* to 17*g* are usually out of contact with the surfaces bounding the openings 18*a* to 18*g*, with the result that the elements 17*a* to 17*g* are movable about the longitudinal axes of the respective rods 20*a* to 20*e* without interference from the carrier member 11. This, on the one hand, is desirable because it makes it relatively easy for a person entrusted with setting up the sign 10 to flip the individual elements 17*a* to 17*g* between their active and inactive positions as required to create the desired image or numeric or alphanumeric character or indicium, However, it also could have an undesirable consequence of permitting the elements 17*a* to 17*g* to move out of their intended active or inactive positions as the sign 10 is subjected to various forces and other external influences. This is why it is advantageous for the rods 20*a* to 20*e* to be received in the associated interstices or flutes 16 of both the carrier member 11 and the respective elements 17*a* to 17*g* with a certain degree of frictional or interference fit in that it assures that a certain amount of resistance will have to be overcome before the respective elements 17*a* to 17*g* are displaced out of their instantaneous positions, a feat that is not expected from accidental external influences.

To avoid this problem, another solution is to use the aforementioned elastomeric elements for the shafts. A linear band of rubber knotted at one end, and threaded through a respective flute, before being knotted at its opposite end, serves as a resilient support shaft that self-compensates for asymmetries and tolerance variations. The outer edge surfaces of the elements 17*a* to 17*g* will now reliably contact the surfaces bounding the openings 18*a* to 18*g*, because the elastomeric element will simply yield as desired to create the frictional fit.

The sign 10 can be installed at the location of its intended use in a variety of ways, one of which is indicated in FIG. 1 of the drawing. In accordance with this installation method, a wire, yarn, cable, string or a similar elongated suspension member 21 is threaded through one of the upper flutes 16 (as shown, the uppermost one) of the carrier member 11, and is then mounted, in a well-known manner that has not been illustrated, in an overhead position on the premises, such as in a retail establishment. As a result, the sign 10 is suspended from the suspension member 21, usually in an array with other signs 10 of the same or similar type, at a convenient location where it will be easily noticed by prospective customers without interfering with their freedom of movement or obstructing their field of view.

Figure 4:
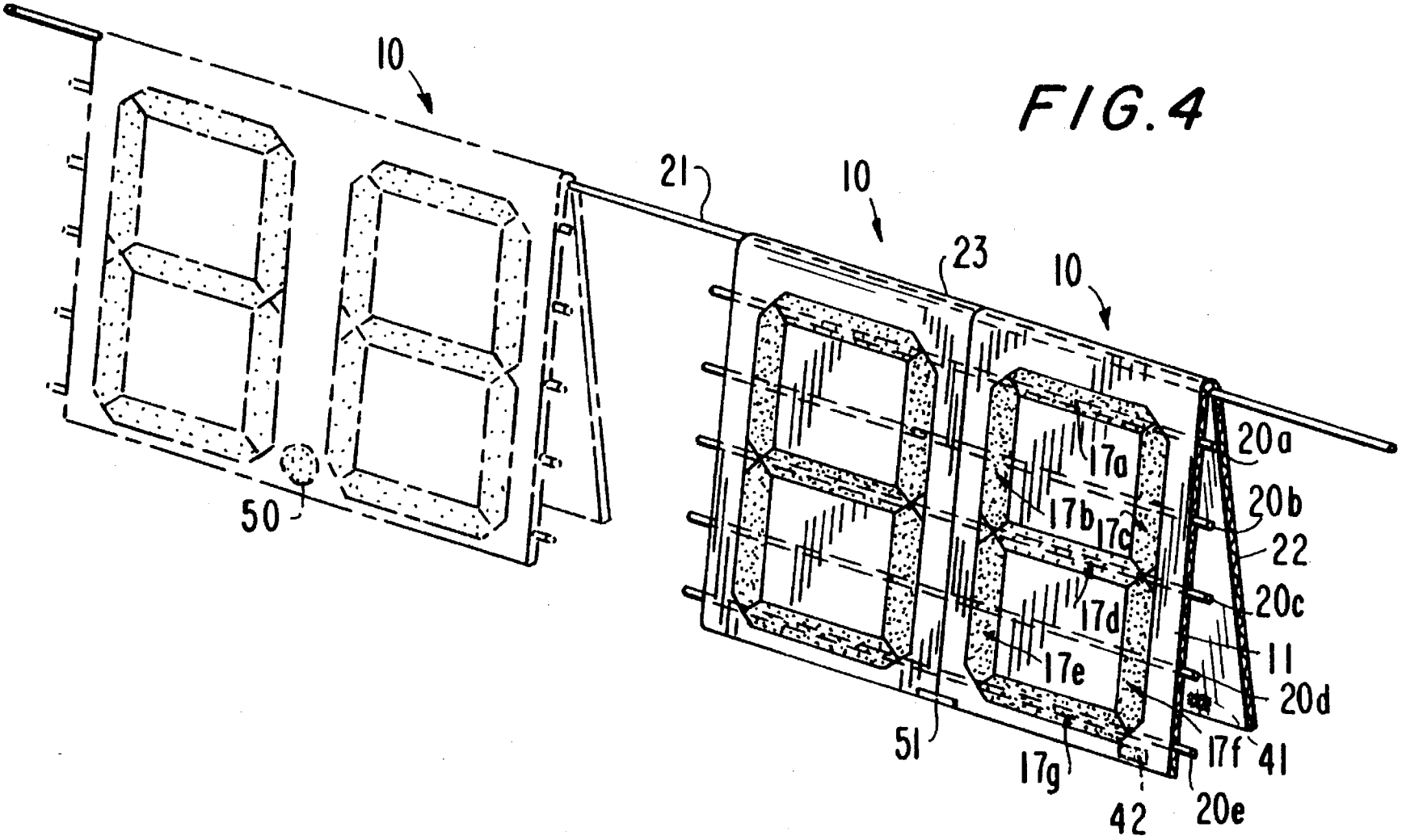
FIG. 4 is a perspective view showing several of the display signs of FIG. 1 in one deployed condition.

Another way of installing the sign 10 (and/or others like it) in an overhead or similar position is depicted in FIG. 4 of the drawing. There, the sign 10, besides including the aforementioned components, also contains a backing plate 22. The backing plate 22 is shown to have substantially the same dimensions as the carrier member 11 and, as a matter of fact, as being integral or of one piece therewith, being joined to the carrier member 11 by a folded-over hinge portion 23. Under these circumstances, it is not necessary to thread the elongated suspension member 22 through the uppermost flute 16; rather, the sign 10 can simply be placed over the suspension member 22 so as to straddle the same. For illustrative purposes, this is indicated in FIG. 4 of the drawing by the flaring disposition of the cardboard members or plates 11 and 22.

However, for the sake of appearance and/or for other reasons, it is currently preferred to maintain the plates 11 and 22 is close proximity to, if not in area contact with, one another. This may be achieved by applying adhesive tape 51 to the bottom portion of the sign 10 so as to span the interface between the plates 11 and 22 and to be adhesively connected thereto. This, however, means that the adhesive tape has to be cut, removed or otherwise destroyed each time it is desired to change the image or indicium displayed by the sign 10. This not only is cumbersome and uneconomical, but also adversely affects the appearance of the sign, at least over the long run, by leaving residue of the adhesive tape application and removal activity on the sign 10. Therefore, it is currently preferred to use so-called Velcro™ fasteners or pads 41, 42 at strategically selected corresponding or juxtaposed locations of the two plates 11 and 22 for engaging each other and thus releasably holding the plates 11 and 22 together.

It should be appreciated that, in the modified construction shown in FIG. 4, the elements 17*a* to 17*g* cannot be moved out of their respective chosen positions, be they active or inactive, by more than a minuscule or negligible amount, since such movement is inhibited by the presence of the backing plate 22 behind and in close proximity to the carrier member 11 and thus the elements 17*a* to 17*g*. This means, for one, that the fit with which the rods 20*a* to 20*e* are received in the respective flutes 16 need not necessarily be frictional because the holding action is brought about by the backing plate 22; yet, it should still be relatively conforming or tight so as to prevent wobbling or other transverse movements of the elements 17*a* to 17*g* on the respective rods 20*a* to 20*e*.

FIG. 4 also shows that, as already alluded to before, the sign 10 need not be used to display a single indicium; rather, a series of such signs, or double-triple- or multi-length signs, can be suspended from the suspending member 21 to form an ordered succession, such as a multi-digit number indicative of a date or a price of a particular item on sale. Under these circumstances, the rods 20*a* to 20*e* may be used to connect the successive signs 10 with one another, by extending across the gap between the adjacent signs 10. This can be accomplished by either having a complete complement of the rods 20*a* to 20*e* associated with each of the signs 10, and having the respective rod 20*a* to 20*e* of one or the other of the adjacent signs 10 extend into the corresponding flute 16 of the other sign 10 while the corresponding rod 20*a* to 20*e* of such other sign 10 retracted to at least the same extent into its flute 16, or to use the rods 20*a* to 20*e* in common for all of the adjacent or successive signs 10, in which case the rods 20*a* to 20*e* would have lengths increased to an appropriate multiple of the individual rod length.

At this juncture, it is to be mentioned that the rods 20*a* to 20*e*, whether they are dimensioned for use with individual ones of the signs 10, or in common for a succession of such signs 10, or for a single sign having multiple indicia, are shown to have lengths that somewhat exceed the corresponding dimension of the respective carrier member 11 or succession of such carrier members 11. This facilitates the manipulation with the rods 20*a* to 20*e* and/or with the elements 17*a* to 17*g* in that the projecting end portions of the rods 20*a* to 20*e* can be easily gripped and shifted or turned as needed to properly position them and/or the elements 17*a* to 17*e*.

Figure 5:
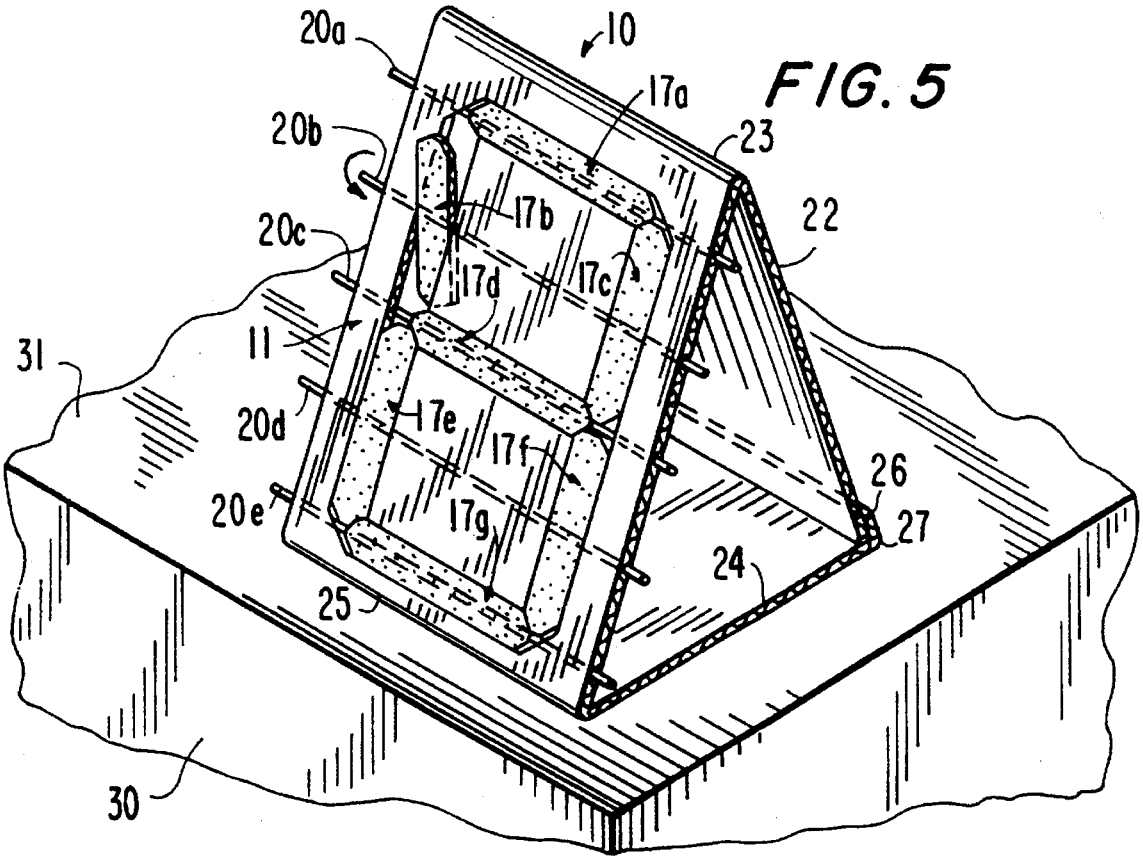
FIG. 5 is a perspective view of a slightly modified version of the display stand of FIG. 1 in another deployed condition.

Turning now to FIG. 5 of the drawing, it may be seen that it reveals a modified construction of the sign 10 that is suited for being supported on top of a structure 30, such as a filing cabinet, a shelving structure or the like, by standing on an upper surface 31 of such structure 30. In this case, the sign 10 includes the backing panel 22 as well, but the latter does not serve to hold the elements 17*a* to 17*e* in their respective active or inactive positions. Rather, its function is to support the carrier member 11 in its illustrated slightly reclining position by virtue of being connected thereto by the hinge portion 23 and extending in a downwardly flaring position relative thereto.

Of course, if the construction of the sign 10 depicted in FIG. 5 of the drawing were only as described so far, there would exist the danger that the bottom edges of the plates or panels 11 and 22 would slide apart on the surface 31, thus flattening the sign 10 and impairing if not annihilating its utility by effectively removing it from the viewing range of purchasing public, To avoid this possibility, the sign 10 is further provided with a bottom panel 24 that is hinged to the carrier member 11 at the bottom portion of the latter by another hinging portion 25, and includes an upstanding abutment portion 26 that, in turn, is connected to the bottom panel 24 by an auxiliary hinging portion 27. It will be appreciated that the abutment portion 26 serves as an abutment for the bottom edge of the backing panel or plate 22, preventing the latter from sliding backwards relative to the corresponding edge of the carrier member or panel 11 to more than the desired extent, This inhibiting action is especially pronounced when the abutment portion 26 and the backing panel 20 are positively connected with one another in some manner, such as by being stapled or taped together. Of course, in this particular construction, frictional retention is all that is holding the elements 17*a* to 17*e* in their chosen (active or inactive) positions, so that care must be taken that it be present, for instance by providing the frictional or interference fit of the rods 20*a* to 20*e* in the respective flutes 16, as mentioned before.

It will be understood that each of the elements described above, or two or more together, may also find a useful application in other types of constructions differing from the type described above.

So, for instance, if it is desired to use a plurality of the signs 10, or multi-length signs, to display prices denominated in dollars and cents, then a period or decimal point having a circular appearance could be painted or otherwise permanently provided on one of such signs 10. On the other hand, it is also contemplated to provide an additional opening and circular element similar to the openings 18*a* to 18*g* and the elements 17*a* to 17*g*, to give them the configuration of a decimal point 50, and to arrange them on the rod 20*e* between two adjacent numerals as shown in FIG. 4. In this case, at most, one of such additional elements will assume its active position and all the others will be in their inactive positions.

While the present invention has been described and illustrated herein as embodied in a specific construction of a changeable display sign, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A device for displaying a changeable image, comprising:

a) a carrier panel having an exposed major surface and a plurality of panel interstices extending in mutual parallelism along a longitudinal direction, said carrier panel having a plurality of openings corresponding to different segments of the changeable image;

b) a plurality of image-forming elements having oppositely facing first and second element surfaces visually conforming to and differing from said exposed major surface, respectively, and a plurality of element interstices extending in mutual parallelism along the longitudinal direction; and c) means for mounting said elements in said openings for turning movement between active and inactive positions in which said first and said second element surfaces are substantially flush with said exposed major surface, respectively, said element interstices being co-linear with said panel interstices in each said position, said mounting means including a plurality of shafts, one for each element, each shaft passing entirely through one of the element interstices of a respective element and also entirely through said panel interstices which are co-linear with said one of the element interstices.

2. The device as defined in claim 1, wherein said carrier panel and each element are each constituted of a corrugated board material having a pair of substantially planar outer walls, and an intermediate wall interposed between said outer walls, extending along an undulating course repeatedly from one of said outer walls to the other and back, and connected to said outer walls at regions of closest approach thereto to define said respective panel interstices and said element interstices, each interstice having a predetermined cross-sectional area.

3. The device as defined an claim 2, wherein each of said shafts has a cross-sectional area that substantially corresponds to said predetermined cross-sectional area of said interstices.

4. The device as defined in claim 2, wherein each of said shafts has a cross-sectional area less than said predetermined cross-sectional area of said interstices.

5. The device as defined in claim 1, and further comprising a backing panel hingedly connected to said carrier panel at an upper region thereof and configured substantially conformingly to said carrier panel.

6. The device as defined in claim 5, wherein said carrier and backing panels form a notch at said upper region thereof for receiving an elongated support member to suspend the display device in a straddling position therefrom.

7. The device as defined in claim 6, and further comprising means for connecting said carrier and backing panels to one another at a lower region thereof.

8. The device as defined in claim 7, wherein said connecting means includes an adhesive tape.

9. The device as defined in claim 7, wherein said connecting means includes at least one pair of fasteners mounted in corresponding positions on said carrier panel and said backing panel.

10. The device as defined in claim 5, and further comprising a bottom wall operative for supporting the device on a horizontal support surface, said bottom wall being hingedly connected to a lower region of said carrier panel and having an upstanding abutment portion remote from said carrier panel and serving as an abutment for a lower region of said backing panel to prevent excessive spreading thereof apart from said carrier panel.

11. The device as defined in claim 1, wherein said image-forming elements are arranged in a pattern resembling at least one stylized numeral eight.

12. The device as defined in claim 11, wherein said image-forming elements are arranged in a pattern resembling a succession of stylized numerals, and including a generally circular element resembling a decimal point located between two adjacent numerals.

13. The device as defined in claim 1, wherein each shaft is a rigid metal rod.

14. The device as defined in claim 1, wherein each shaft has end regions extending beyond the carrier panel.

15. The device as defined in claim 1, wherein a first group of said plurality of image-forming elements are elongated along the longitudinal directions, and wherein a second group of said plurality of image forming elements are elongated along a transverse direction perpendicular to the longitudinal direction, and wherein said shafts extend lengthwise through each element of said first group, and widthwise through each element of said second group.

* * * * *